US005376462A

United States Patent [19]

Anderson

[11] Patent Number: 5,376,462

[45] Date of Patent: Dec. 27, 1994

[54] THIXOFORMABLE LAYERED MATERIALS AND ARTICLES MADE FROM THEM

[75] Inventor: Peter R. G. Anderson, Worcestershire, England

[73] Assignee: Lucas Industries public limited company, Solihull, England

[21] Appl. No.: 63,522

[22] Filed: May 18, 1993

[30] Foreign Application Priority Data

May 20, 1992 [GB] United Kingdom ..... 9210763

[51] Int. Cl.[5] ..... B22F 7/02

[52] U.S. Cl. ..... 428/546; 428/545; 428/549; 419/5; 419/6; 419/7; 419/8; 419/9

[58] Field of Search ..... 428/545; 164/5, 46, 164/97; 425/545, 546, 549; 419/5, 6, 7, 8, 9

[56] References Cited

U.S. PATENT DOCUMENTS

| | | | |
|---|---|---|---|
| 4,804,034 | 2/1989 | Leatham et al. | 164/46 |
| 4,926,923 | 5/1990 | Brooks et al. | 164/5 |
| 4,926,924 | 5/1990 | Brooks et al. | 164/5 |
| 5,165,463 | 11/1992 | Aghajanian | 164/97 |

FOREIGN PATENT DOCUMENTS

| | | |
|---|---|---|
| 191008 | 1/1986 | European Pat. Off. . |
| 0191008 | 8/1986 | European Pat. Off. . |
| 0270265 | 6/1988 | European Pat. Off. . |
| 270265 | 6/1988 | European Pat. Off. . |
| 0299944 | 1/1989 | European Pat. Off. . |
| 93303813.5 | 9/1993 | European Pat. Off. . |
| 810223 | 8/1951 | Germany . |
| 1599392 | 9/1981 | United Kingdom . |
| PWO92/122-72 | 7/1992 | WIPO . |

OTHER PUBLICATIONS

Japanese Abstract JP3215655, published Sep. 20, 1991 to I. Yoshio.

*Primary Examiner*—Donald P. Walsh
*Assistant Examiner*—John N. Greaves
*Attorney, Agent, or Firm*—Hudak & Shunk Co.

[57] ABSTRACT

A thixoformable material and a method for forming it are provided in which the material comprises a series of sequentially deposited layers of substantially metallic material, at least some of the layers having different properties. The layers may be of different materials or the layers may differ in that some are provided with reinforcing material whereas other are not. The reinforcing material may consist of particles of spherical, fiberous or other shapes and may be made of various carbides or other suitable reinforcing materials.

The thixoformable material may be formed in sheets, cylindrical forms or any other shape and subsequently cut to the volume and/or shape required for the forming stage.

A layered material of this sort offers the advantages of thixoformable materials but with enhanced toughness and damage resistance due to the layered 3-dimensional structure.

13 Claims, 2 Drawing Sheets

THIXOFORMABLE LAYERED MATERIALS AND ARTICLES MADE FROM THEM

This invention relates to thixoformable materials of the kind formed by permitting solidification of molten metals under conditions of agitation.

Thixoforming is a process for forming metals and alloys in a single operation using low forming loads and temperatures substantially below those required for casting the same material. The process uses the metal or alloy in a semi-solid state and is based on the use of billets or pre-forms in which the dendrite structure which normally forms during solidification is destroyed by stirring or otherwise agitating the solidifying material. The resulting product is thixotropic on heating, behaving substantially as a liquid at high shear rates and as a solid at low shear rates.

A number of processes exist for forming thixotropic materials such as mechanical stirring, as in the original M.I.T. process, induction electromagnetic stirring and other methods. In these processes the solidifying alloy is stirred during cooling. The billet so formed may be used in subsequent casting or used immediately. In another process the so called Osprey process, the molten alloy is sprayed onto a deposit, or collector, which is cooled in a controlled manner. The spray is obtained by gas atomisation using an inert gas. The deposit so formed may then be used to cast the desired article after reheating.

In both these processes particulate reinforcing material, comprising one or more from materials such as silicon carbide, boron carbide, titanium carbide and other carbides or nitrides, alumina, magnesia, boron, mica, anthracite, glass, ceramic or intermetallic particles or "whiskers" may be introduced.

These particles may be introduced to the melt prior to casting the billets or sprayed into the atomised melt spray during that stage. In this way tensile strength and other properties may be improved, but the toughness, (resistance to sudden impact) is reduced compared with the unreinforced material.

The billet, pre-form or deposit can subsequently be reheated to a temperature at which some 30–70% of the material is liquid, at this stage the billet will still behave as a solid. The billet or a portion of it may then be transferred to a forming process such as die casting or forging, which can then take place at very low pressures.

Whilst these techniques produce a reinforcable, good surface finish, close tolerance product which has a lower energy requirement due to the lower temperatures involved, the product has a low toughness compared with conventional forging products. Other comparible materials such as long fibre reinforced metal are difficult and very costly to manufacture.

According to a first aspect of the invention we provide a method of improving the properties of thixoformable material comprising the steps of sequentially depositing layers of substantially metallic material onto a collector in which at least two of the layers are formed of materials having different properties.

Preferably the layers are deposited concentrically on the collector. Most preferably the collector is of substantially cylindrical shape.

Any number of different layers may be applied, the layers may be applied sequentially in a repetitive manner, in repetitive blocks, or in any other sequence to obtain the properties and characteristics desired.

The layers may differ in that some contain reinforcing material whereas others are unreinforced. Alternatively the reinforcing material used may differ between layers.

Preferably alternate layers have different properties. The different properties may be because of different compositions, alignment, treatments or processing of the materials. Alternatively the layers may have different properties over different sections of the pre-form.

The different layers may be of constant thickness or may vary. Different thicknesses may be applied to different sections of the pre-form.

In this way a material is produced which has the beneficial properties of thixoformable material but which has additional toughness and damage resistance due to a layered 3-dimensional structure and the properties of the particulate reinforcing materials. The semi-liquid nature of the material during subsequent forming should also ensure a good integral bond between the different layers forming the composite material. This may be due to limited mixing of the fluid portion, or portions, at the layer boundaries which serve to bind the layers together upon solidification.

According to a second aspect of the invention we provide a pre-form slug or blank of thixoformable material comprising layers of material in which at least two of the material layers have different properties.

Preferably the layers of different properties alternate. Most preferably the material is formed from layers of reinforced material and unreinforced material.

The reinforced material may be reinforced by deliberately introduced material or the reinforcement may be formed in-situ.

The unreinforced material may be the same as the reinforced material but without the reinforcement or it may differ in composition, properties, treatment or other characteristics.

The reinforcing material may comprise ceramic, metallic or intermetallic particles. The reinforcing material may be spherical, fibrous or any other shape. The reinforcing material may be present in random orientation so giving isotropic properties or the reinforcing material may be aligned in some way to give anisotropic properties.

According to a third aspect of the invention we provide a component formed from a thixotropic material comprising layers of material in which at least two of the layers have different properties.

Embodiments of the invention will now be described by way of example only with reference to the accompanying drawings of which:

FIG. 1 shows a preform of the material being formed using a spray forming method.

Figure 1:
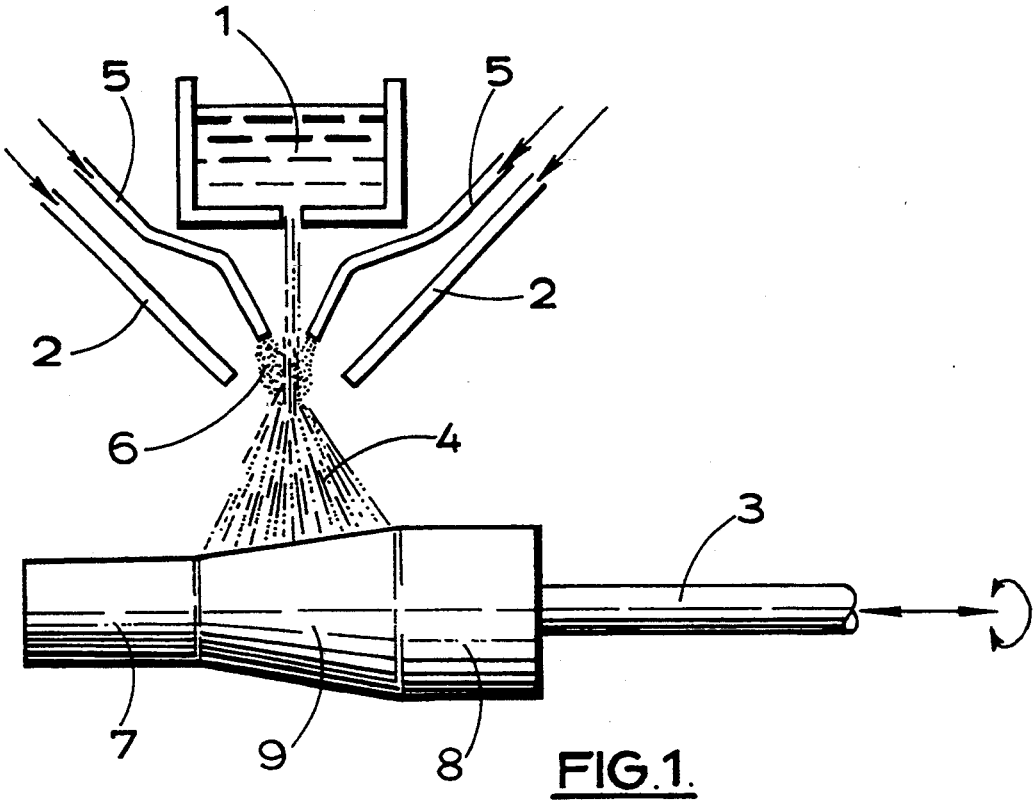
FIG. 1 is a view of a preform being made by spray-forming.

The molten metal 1 is atomised by a stream of inert gas 2, typically nitrogen or argon, and sprayed on to a rotating and reciprocating collector 3. The droplets forming the spray 4 are commonly about 100 μm in diameter.

The material is cooled by gas 5 blown into the chamber and by the rheostat controlled collector 3. The force of the impact of the spray on the collector 3 together with the cooling ensure that thixotropic material without dendrite structure is formed.

The reinforcing material is added to the spray 4 by means of injection by additional blowers to intimately mix the particles 6 with the spray 4 prior to their contact with the collector 3. When a layer 7 of the desired thickness has been applied to the collector, it is then sprayed with the same molten material 1 but without the addition of particulate reinforcing matter 8 to build up the sprayed zone 9 to the required level.

Figure 2:
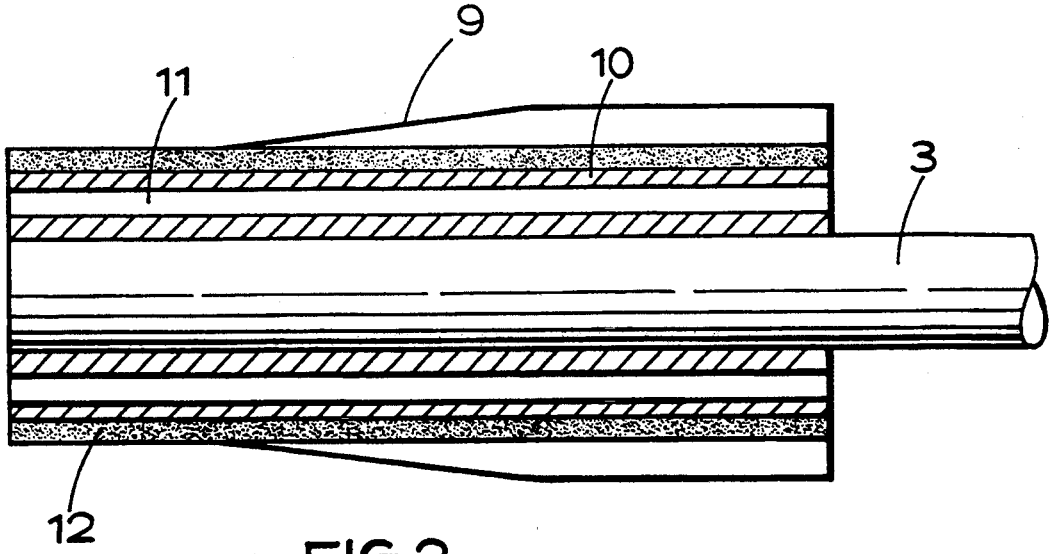
FIG. 2 is a cross-section of the preform of FIG. 1 showing the different layers.

By repeating this cycle over and over a pre-form having alternate layers of reinforced 10 and unreinforced 11 and other layers 12 may be created, as shown in FIG. 2. The other layers 12 may be reinforced with a different reinforcing material, have a different composition or any of a number of different properties.

Figure 3:
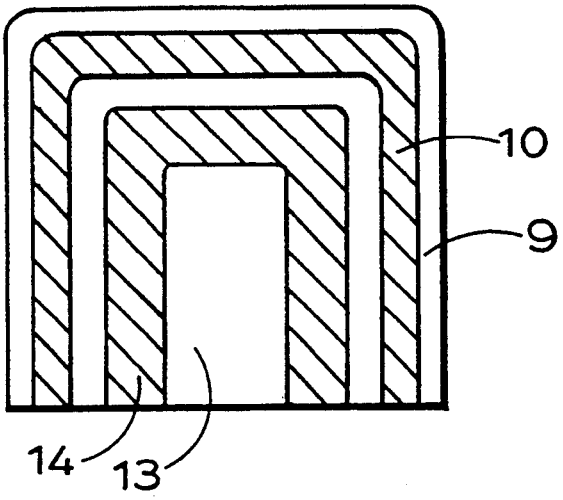
FIG. 3 shows a section through a pre-from formed in a different orientation.

Pre-forms of other orientations may be formed such as that shown in FIG. 3 where the ends of the pre-form are also layered and the thickness of the layers is varied 13, 14.

The preform can then cut into blanks of the correct volume for the component to be formed in the die casting stage.

The blank is then heated, if necessary, to ensure that sufficient of the material is molten for it to behave thixotropically and is placed in proximity with the die. The material is heated to the region where 60–70% is molten for die casting and 30–40% for forging.

Figure 4:
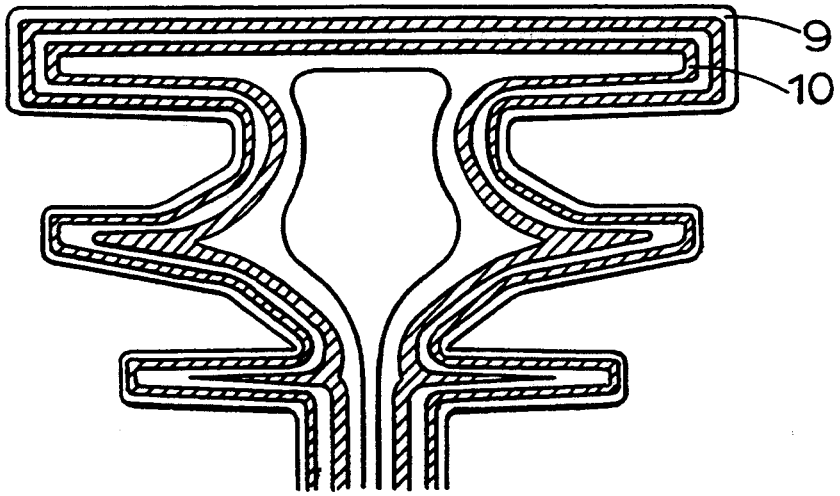
FIG. 4 shows a cross-section through a component formed by die casting of the pre-form in FIG. 3.

The thixotropic blank may then be forced into the die under relatively low pressures and allowed to cool to form the component. Because of the lower molten contents in forging operations the pressures used are consequently higher. When forced into the die the material stretches and flows to occupy the desired shape, thinning each of the layers but substantially maintaining their alternate arrangement, as the high viscosity ensures laminar flow, as illustrated in FIG. 4. This so called "solid-front fill" greatly reduces the chance of air entrapment within the component. The lower solidification shrinkage of a semi-solid also improves the integrity of the component.

In this way a component with alternating layers may be formed. The alternating component benefits from the improved toughness of the unreinforced layer. The combination also has advantages in controlling the propagation of cracks and fractures through the component by causing crack branching and deviation. This results in increased damage tolerance and fracture toughness.

Furthermore, by careful arrangement of regions of different thicknesses and/or properties at different locations on the pre-form, different parts of the component produced may have different predominant characteristics.

Other techniques for producing the billet are envisaged such as sequential casting where a volume of molten material is placed in a cast around a core of solidified material. The volume of the solidified core being such that its temperature remains at a point below its melting point and the molten material solidified under agitation so as to form a layer of material. A series of increasing cast sizes or an expandable cast may be used to produce the billet.

The molten material may be agitated by induced electromagnetic means or by rotating the solidified core.

The possibility of using a series of spray forming machines to apply the layers of materials is also envisaged. In this way a first machine may be used to apply one layer, the preform may then be transferred to a second machine for the next layer and so on. A different machine being used for each material required.

I claim:

1. A method of improving the properties of a thixoformable material wherein said thixoformable material is deposited sequentially in layers, said thixoformable material being of substantially metallic material, at least two of said layers being formed of materials having different properties and one or more of said layers being of non-constant thickness.

2. A method according to claim 1 wherein said layers are applied sequentially in a repetitive manner.

3. A method according to claim 1 wherein two or more of said layers are applied in different thicknesses.

4. A method according to claim 1 wherein one or more of said layers contain reinforcing material.

5. A method according to claim 4 wherein in one or more of said layers said reinforcing material is aligned.

6. A method according to claim 1 wherein said different properties of said materials are due to the different compositions of said materials.

7. A pre-form of thixoformable material wherein said pre-form comprises two or more layers, at least two of said layers have different properties and one or more of said layers is of non-constant thickness.

8. A pre-form according to claim 7 wherein said different properties are due to the presence of reinforcing material in at least one of said layers and the absence of said reinforcing material from at least one of said layers.

9. A pre-form according to claim 7 wherein said pre-form has anisotropic properties.

10. A pre-form according to claim 8 wherein said reinforcing material comprises ceramic, metallic, or intermetallic particles.

11. A pre-form according to claim 10 wherein one or more of said layers is provided with reinforcing material, said reinforcing material being preferentially aligned to give said anisotropic properties.

12. A component formed from a thixotropic material wherein said component comprises two or more layers of material, at least two of said layers having different properties and one or more of said layers having regions of different thicknesses.

13. A method of forming a component comprising:

(a) making a pre-form by sequentially depositing in layers a substantially metallic thixoformable material, at least two of the layers being formed of materials having different properties and one or more of said layers being of non-constant thickness;

(b) ensuring the blank is sufficiently molten for it to behave thixotropically:

(c) introducing the blank to a die;

(d) forcing the blank into a die, the arrangement of regions of different thicknesses causing different parts of the component to have different predominant characteristics.

* * * * *